US006020549A

United States Patent [19]

Reimann et al.

[11] Patent Number: 6,020,549

[45] Date of Patent: Feb. 1, 2000

[54] APPARATUS AND METHODS FOR MODIFYING PIANO KEYBOARDS

[76] Inventors: Hannah Reimann, 103 E. 86th St. - #8D, New York, N.Y. 10028; Ludwig Tomescu, 260 W. 52nd St. - #5F, New York, N.Y. 10019

[21] Appl. No.: 09/132,064

[22] Filed: Aug. 10, 1998

[51] Int. Cl.[7] ..... G10C 3/12

[52] U.S. Cl. ..... 84/423 R; 84/433; 84/436

[58] Field of Search ..... 84/423 R, 423 A, 84/423 B, 424–441

[56] References Cited

U.S. PATENT DOCUMENTS

| | | | |
|---|---|---|---|
| 206,345 | 7/1878 | Milliken . | |
| 745,509 | 12/1903 | Muller . | |
| 842,539 | 1/1907 | Simmons . | |
| 952,509 | 3/1910 | Caufield . | |
| 1,795,468 | 3/1931 | Bonilla . | |
| 2,505,806 | 2/1950 | Stein . | |
| 2,627,777 | 2/1953 | Robbins | 84/423 R X |
| 3,072,005 | 1/1963 | Quitter . | |
| 3,381,576 | 5/1968 | Johnson . | |
| 3,456,545 | 7/1969 | Kondo . | |
| 3,499,362 | 3/1970 | Harada . | |
| 4,127,051 | 11/1978 | Conklin, Jr. . | |
| 4,658,695 | 4/1987 | Cutler . | |
| 4,782,734 | 11/1988 | Rose | 84/423 R |

*Primary Examiner*—Stanley J. Witkowski
*Attorney, Agent, or Firm*—Galgano & Burke

[57] ABSTRACT

Aspects of the present invention provide relatively inexpensive methods and apparatus for modifying existing pianos to provide interchangeable keyboards of different sizes without sacrificing or impairing the quality of the original piano. The keys of a standard piano are removed and the pins in the front rail of the key frame are replaced with pins which are more closely positioned. The original keys are then replaced with new keys of narrower dimensions which are more closely positioned in the area of the front rail.

20 Claims, 6 Drawing Sheets

APPARATUS AND METHODS FOR MODIFYING PIANO KEYBOARDS

The present invention is directed to apparatus and methods for modifying piano keyboards, and, particularly, for modifying existing piano keyboards to provide for the interchangeability of keyboards of different sizes for different pianists.

BACKGROUND OF THE INVENTION

People have enjoyed playing pianos for many years. One of the most highly regarded pianos in the world is the Steinway piano which is known for its excellent tonal quality and craftsmanship. Steinway pianos are preferred by many concert pianists around the world. Due to their high quality and labor intensive manufacturing process, high quality pianos are very expensive.

One shortcoming of popular pianos is that they are often manufactured with keyboards of one standard size. Therefore, all persons playing such pianos, from the beginner to the accomplished concert pianist must learn to play this particular size keyboard. While the standard size is very suitable for most people, pianists of smaller physical makeup would find it more desirable to play on a slightly smaller keyboard. Accomplished pianists, however, do not wish to sacrifice the high quality of a piano to which they are accustomed, nor would they wish to replace an existing high quality piano, such as a Steinway, in order to obtain a smaller keyboard.

It would therefore be desirable to provide apparatus and methods for modifying an existing piano to provide a keyboard with a different size and, it would be particularly preferable to provide apparatus and methods for converting a piano to provide keyboards having smaller sizes.

SUMMARY OF THE INVENTION

The various embodiments of the present invention provide apparatus and methods for modifying existing pianos, and are particularly suited for concert quality grand pianos such as Steinway pianos. The present invention advantageously provides relatively inexpensive methods and apparatus for modifying existing pianos to provide interchangeable keyboards of different sizes without sacrificing or impairing the quality of the original piano.

According to one aspect of the present invention, the keys of a standard piano are removed and the pins in the front rail of the key frame are replaced with pins which are more closely positioned. The original keys are then replaced with new keys which are more closely positioned in the area of the front rail (the "ivory" portion of the keys), but are in the same position as the original keys in the area under the hammers, commonly referred to as the "action". According to various embodiments of the present invention, the pins on the balance rail of a key frame may either be retained in their original positions or may be moved, e.g., by moving the pins on the balance rail closer together.

According to another aspect of the present invention, the original pins in the front rail of a key frame are removed and a prefabricated pin strip is connected to the original front rail. The prefabricated pin strip has pins with different spacing. According to still another aspect of the invention, a plurality of prefabricated pin strips are connected to the front rail of the key frame in order to provide the desired pin placement.

According to still another aspect of the present invention, the front rail of a key frame is removed and a substitute front rail is connected to the rest of the key frame.

According to another aspect of the present invention, a piano is modified to provide a smaller keyboard without modifying the action pin plate guide. Those skilled in the art will appreciate that the precise positioning of the action pin plate guide is important since it maintains the same relative position of the hammers and the strings. Slight changes in the relative position of the hammers and the strings will change the sound of the piano significantly. It is therefore most desirable to provide methods and apparatus for converting pianos which do not modify the position of the action pin plate guide in order to minimize the risk that the modified piano will require significant readjustment to restore the original sound.

DETAILED DESCRIPTION OF THE PREFERRED EMBODIMENTS

The various embodiments of the present invention relate to apparatus and methods for modifying a piano to provide a keyframe of different size. The preferred illustrated embodiments of the present invention provide piano keyboards which are smaller than the original keyboards and, therefore, more suited for smaller pianists. The preferred embodiments of the present invention allow for reverse conversions, i.e., they allow a piano which has been converted to a smaller size keyboard to have the smaller size keyboard subsequently replaced with the original or another size keyboard.

Figure 1A:
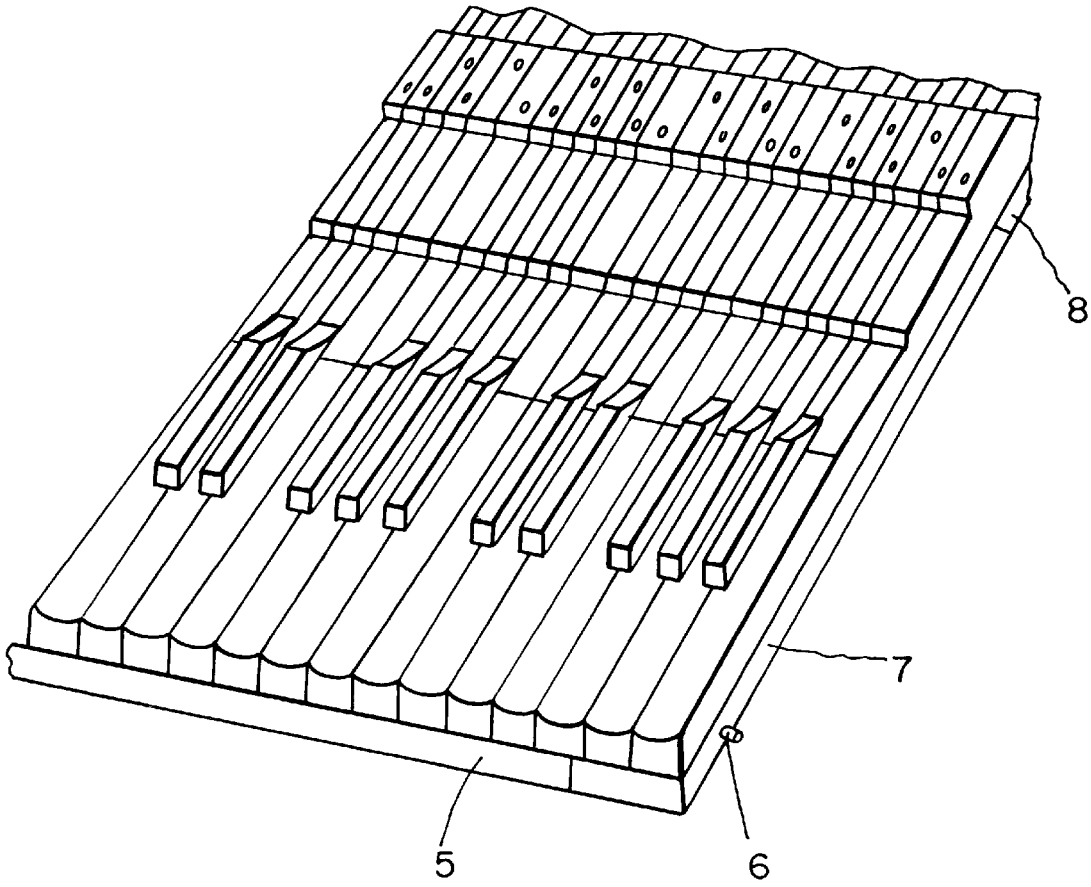
FIGS. 1A and 1B are partial perspective views of an original piano keyboard and a keyboard modified by the present invention, respectively.
Figure 1B:
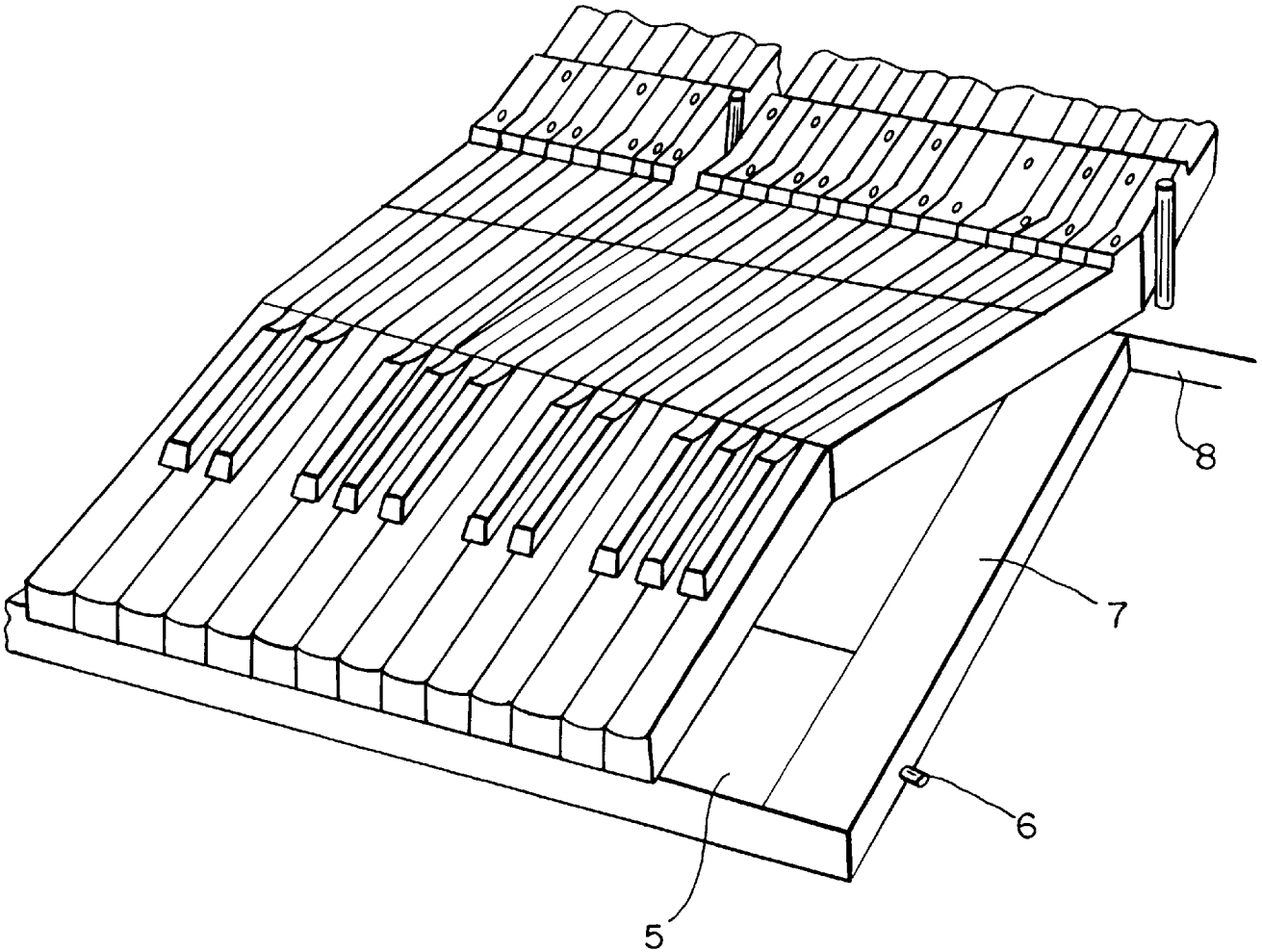

FIGS. 1A and 1B are sections of an original piano keyboard and a modified piano keyboard, respectively. As shown most clearly in FIG. 1B, the keys are supported on a key frame having a front rail 5, a side rail 7 and an alignment pin 6. A balance rail 8 supports a middle section of the keys.

Figure 2A:
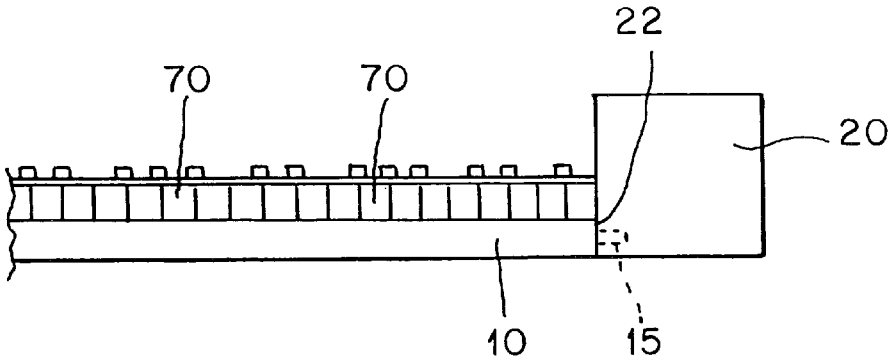
FIGS. 2A and 2B are front views of an original piano keyboard and a keyboard modified by the present invention, respectively.
Figure 2B:
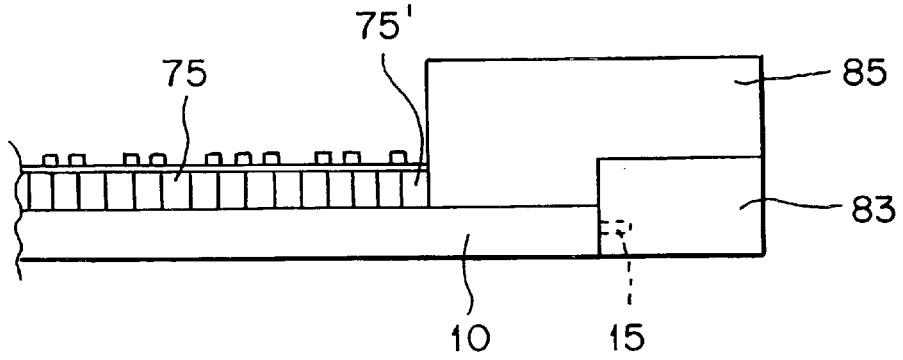

As illustrated, the replacement keys utilized in FIG. 2B have narrower forward sections, commonly referred to as the "ivory" which are played by the pianist. However, the rearward section of the keys are advantageously maintained in the same position as the original keys in order to minimize the number of parts which need to be replaced by the conversion and which would therefore more likely require adjustment after a conversion. Upon reading this disclosure, it will be apparent to those skilled in the art that one goal of the present invention is to minimize the number of elements which are actually replaced during the conversion in order to minimize costs of both materials and labor, as well as to minimize the risk of misalignment.

Those skilled in the art will appreciate that piano keys are typically supported on a key frame comprising a forward rail, a balance rail and a rearward rail. Each key is advantageously supported by the front and balance rails with at least one pin which maintains the proper vertical alignment of the keys. Since at least the forward sections of the replacement keys take up less space on the key frame than the original keys, it will be appreciated that it is necessary to move the pins on at least the forward rail of the key frame closer to each other and toward the center of the key frame in order to accommodate the new keys which are smaller and shifted toward the center of the keyboard.

Those skilled in the art will also appreciate that in order to ensure and maintain the proper alignment of the action with the strings, piano key frames are typically provided with pins or other locking members which are received within key blocks (sometimes called "cheek blocks") positioned to the right and left of the keys. In the illustrated embodiment of the present invention and as best shown in FIGS. 2A and 2B, the key frame 10 comprises an alignment pin 15 which is received within an action pin plate guide 22 located in the lower section of the key block 20. Those skilled in the art will also appreciate that the receptacle in the action pin plate guide 22 which receives the alignment pin of the key frame is advantageously adjustable to permit adjustment of the position of the entire key frame and thereby the action with the piano strings (not shown).

The present invention offers several methods for moving the forward rail pins in order to accommodate the smaller and more closely centered keys. The various figures of the present invention are not intended to be drawn to scale but are provided to illustrate the present invention.

Figure 3A:
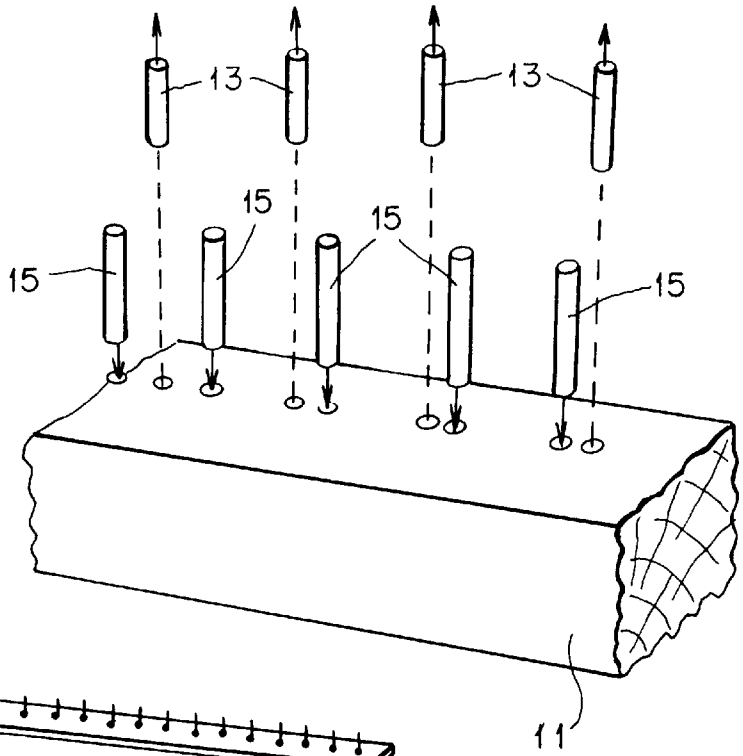
FIG. 3A is a close-up view of a section of a front rail of a key frame illustrating one manner of modification.

FIG. 3A illustrates a section of a forward key rail 11 on the left side of a piano (as a pianist would face the keys during play). According to this embodiment of the present invention, the original pins 13 of the key rail 11 are removed, the original pin holes are filled, new pin holes are drilled in positions properly aligned with the positions for the smaller replacement keys, and the original pins or new pins 15 can then be positioned and secured to the front rail 11. While this particular method is more labor intensive than other methods described below, it can be accomplished with minimal additional materials. From the present description, it will also be appreciated by those skilled in the art that the various methods for repositioning pins described herein can be utilized not only on the front rail but also on the balance rail.

Figure 3B:
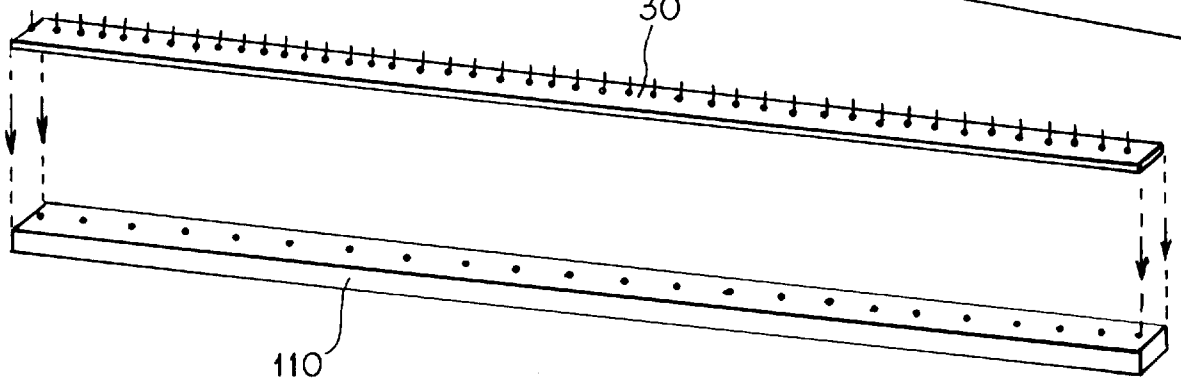
FIG. 3B illustrates an alternative manner of modifying the pin placement on a rail of a key frame.
Figure 3C:
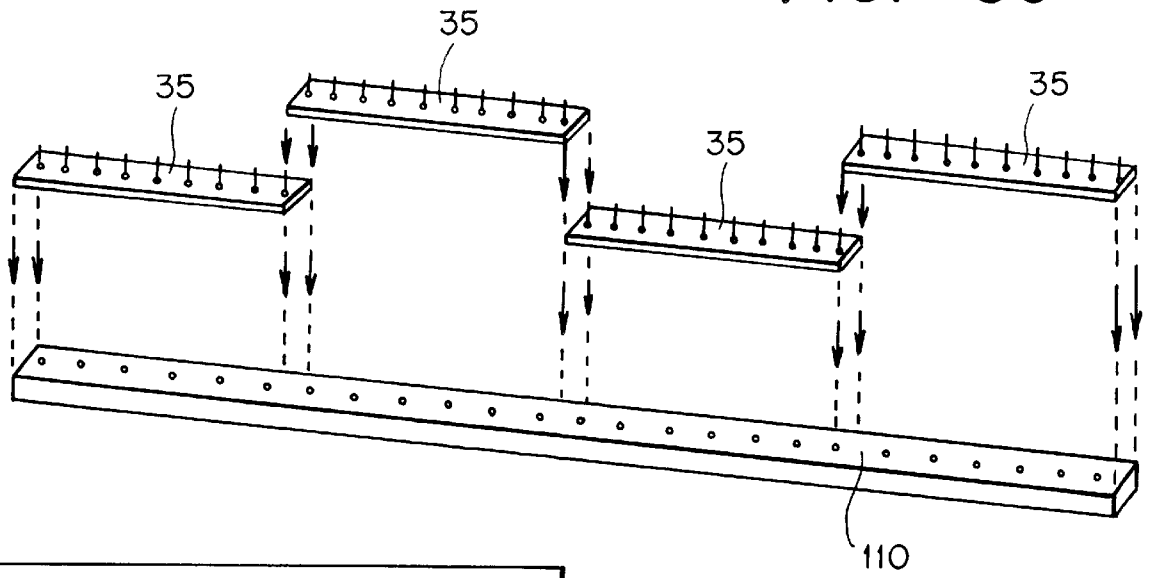
FIG. 3C illustrates still a further manner of modifying the pin positions on a rail of a key frame.

According to another embodiment of the present invention, the repositioning of pins on one or more of the rails of the key frame is accomplished by removing the original pins, either by pulling them out of the original key frame rail or simply cutting them down so that they are flush with the surface of the key rail, and then attaching a prefabricated pin strip 30 to the key frame rail 110 as shown in FIG. 3B. Those skilled in the art will appreciate that this method advantageously lends itself to a very quick conversion since the replacement pin strip 30 can readily be secured to the key frame rail 110 with screws or other releasable fasteners which allow for reconversion back to the original size keyboard or some other size subsequently desired. This method is particularly desirable for very expensive and old pianos which may be considered priceless and which are played by pianists of different size. By fabricating pin strips with respective pins positioned for different size key layouts, a piano can readily be converted back and forth repeatedly for different size key layouts. A modification of the embodiment and method illustrated in FIG. 3B is shown in FIG. 3C, wherein a pin strip is formed in a plurality of pin strip sections 35 in order to reduce the cost of manufacturing, shipping and to facilitate ease of handling by piano technicians. While the embodiment of the present invention illustrated in FIG. 3C illustrates the use of four pin strip segments, a greater or lesser number of pin strip segments 35 can be utilized within this embodiment of the present invention.

Figure 4B:
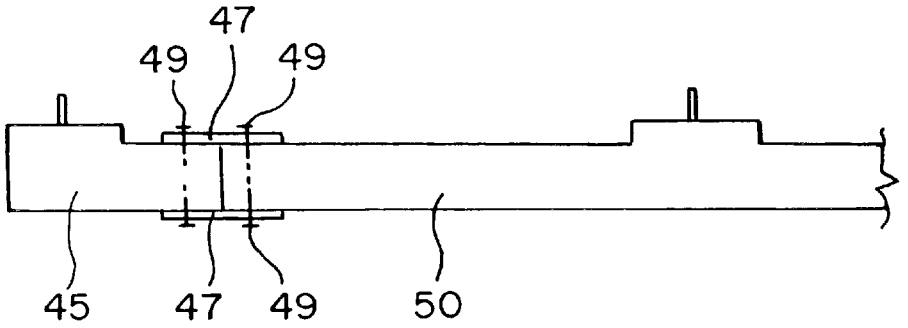
FIGS. 4A and 4B illustrate a still further manner of modifying the front rail of a piano key frame.
Figure 4A:
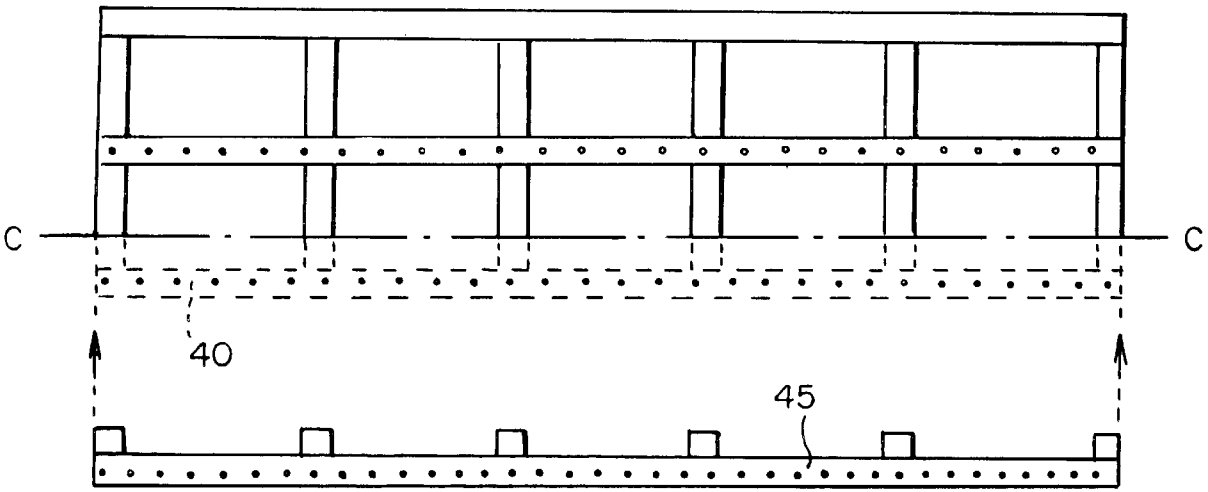

According to another embodiment of the present invention illustrated in the top and front views shown in FIGS. 4A and 4B, respectively, the original front rail 40 (shown in phantom) of a key frame is removed by cutting the supports along line C—C and a replacement front rail 45 having properly positioned pins attached thereto. For example, as best shown in FIG. 4B, according to this embodiment of the present invention, a replacement front rail 45 is attached to a plurality and preferably all of the key frame supports 50 with brackets 47 and screws 49. From the present description, those skilled in the art will appreciate that this embodiment also facilitates a reconversion or subsequent conversion after the piano has been modified.

From the present description and as shown in FIGS. 2A and 2B, when the original keys 70 have been replaced by smaller replacement keys 75, a space would be made between the last key 75' and the original key block 20. If no other action was taken, the key frame would be exposed and the pianist's visual orientation would be severely comprised.

Figure 5A:
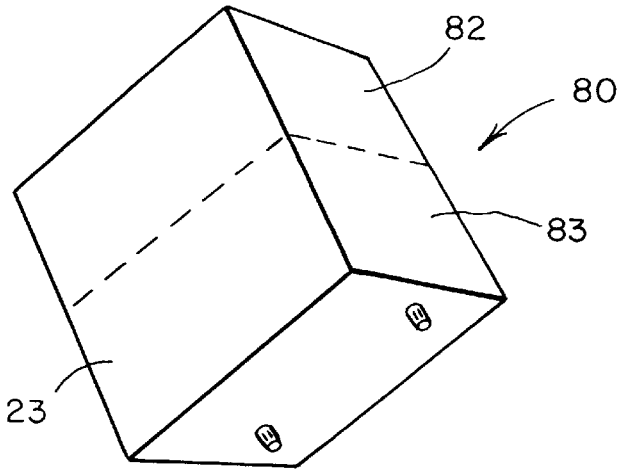
FIGS. 5A–5C illustrate one preferred embodiment of the present invention which modifies an action pin plate guide.
Figure 5C:
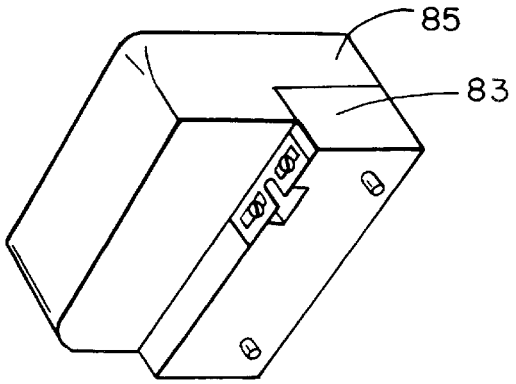
Figure 5B:
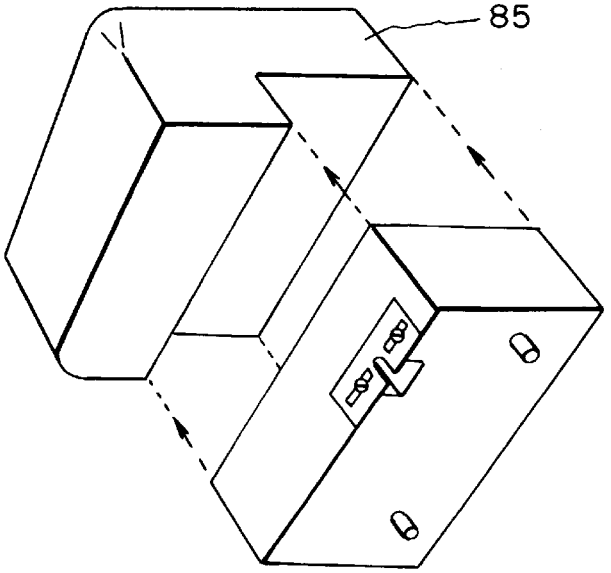

FIGS. 5A–5C illustrate one preferred manner of avoiding these disadvantages. According to this aspect of the present invention, an upper portion 82 of the original key block 80 is cut off and an L-shaped block 85 is positioned on the remaining lower section 83 of the original key block in the manner shown in FIGS. 5B and 5C. In the manner illustrated, the replacement upper section 85 of the key block extends inwardly beyond the original edge 81 of the original key block in order to fill the gap left by the smaller keys. This added side section extends only partially down the inner edge 81 of the remaining lower portion of the key block 83 in order to permit the original key frame 10 and alignment pin 15 to engage the original action pin plate guide 22. The positioning of the replacement key block section 85 relative to the remaining original key block section 83 as well as to the replacement keys 75 and an original key frame 10 are illustrated in FIG. 2B.

Another aspect of the present invention comprises a conversion kit for a piano having a key frame and a plurality of first keys having striking sections supported by said key frame, said key frame comprising a front rail and a plurality of front rail pins wherein at least some adjacent front rail pins are spaced by a first distance, said kit comprising replacement pins for said first front rail pins, and replacement keys having striking sections with different widths than the striking sections of said first keys.

From the present description, those skilled in the art will appreciate that relatively simple and inexpensive methods and apparatus are provided for converting an existing piano to provide a keyboard having a different size. Various embodiments of the present invention are particularly advantageous in that they allow a piano keyboard to be converted from an original size to a second size and then subsequently either reconverted back to the original size or to a third size as desired. Those skilled in the art will appreciate that by utilizing one or more aspects of the present invention, an expensive concert piano can readily be modified for a wide selection of visiting performers without the necessity of ever moving the piano from its location and incurring the risk inherent in such a move. These and other advantages will be apparent to those skilled in the art from the present description.

What is claimed is:

1. A method of modifying a piano to provide a keyboard of a different size, said piano comprising a key frame and a plurality of first keys having striking sections supported by said key frame, said key frame comprising a front rail and a plurality of front rail pins wherein at least some adjacent front rail pins are spaced by a first distance, comprising the steps of:

removing a plurality of said first keys;

changing the spacing of at least some of said front rail pins; and replacing a plurality of said keys with replacement keys having striking sections with different widths than the striking sections of said first keys.

2. A method according to claim 1 wherein said step of changing the spacing of at least some of said front rail pins comprises:

removing a plurality of said front rail pins from said front rail; and connecting a plurality of replacement pins to said front rail wherein at least some adjacent replacement pins are spaced by a second distance which is different from said first distance.

3. A method according to claim 2 wherein said step of connecting a plurality of replacement pins to said front rail comprises drilling holes in said front rail and placing pins in said holes.

4. A method according to claim 2 wherein said step of connecting a plurality of replacement pins to said front rail comprises connecting at least one replacement pin plate comprising a plurality of spaced pins to said front rail.

5. A method according to claim 2 wherein said step of connecting a plurality of replacement pins to said front rail comprises connecting a plurality of replacement pin plates comprising a plurality of spaced pins to said front rail.

6. A method according to claim 1 wherein said step of changing the spacing of at least some of said front rail pins comprises replacing at least a portion of said front rail.

7. A method according to claim 1 wherein said step of changing the spacing of at least some of said front rail pins comprises replacing said front rail.

8. A method according to claim 1 wherein said piano comprises an action pin plate guide and said method further comprises the step of modifying said action pin plate guide so that a side of said action pin plate guide is proximate to said replacement keys.

9. A method according to claim 1 wherein said striking sections of said replacement keys are narrower than the striking sections of said first keys.

10. A method according to claim 1 wherein said key frame comprises a balance rail with a plurality of spaced pins and said method further comprising the steps of changing the spacing of at least some of said balance rail pins.

11. A method according to claim 10 wherein said step of changing the spacing of at least some of said balance rail pins comprises:

removing a plurality of said balance rail pins from said balance rail; and connecting a plurality of replacement pins to said balance rail wherein at least some replacement pins are spaced by a distance which is different from said first distance.

12. A method according to claim 11 wherein said step of connecting a plurality of replacement pins to said balance rail comprises drilling holes in said balance rail and placing pins in said holes.

13. A method according to claim 11 wherein said step of connecting a plurality of replacement pins to said balance rail comprises connecting at least one replacement pin plate comprising a plurality of spaced pins to said balance rail.

14. A method according to claim 11 wherein said step of connecting a plurality of replacement pins to said balance rail comprises connecting a plurality of replacement pin plates comprising a plurality of spaced pins to said balance rail.

15. A method according to claim 11 wherein said step of changing the spacing of at least some of said balance rail pins comprises replacing at least a portion of said balance rail.

16. A method according to claim 11 wherein said step of changing the spacing of at least some of said balance rail pins comprises replacing said balance rail.

17. A conversion kit for a piano having a key frame and a plurality of first keys having striking sections supported by said key frame, said key frame comprising a front rail and a plurality of front rail pins wherein at least some adjacent front rail pins are spaced by a first distance, said kit comprising:

replacement pins for said first front rail pins, and replacement keys having striking sections with different widths than the striking sections of said first keys.

18. A conversion kit for a piano according to claim 17 wherein said replacement pins are connected to at least one replacement pin plate.

19. A conversion kit for a piano according to claim 17 wherein said replacement pins comprises a plurality of replacement pin plates.

20. A conversion kit for a piano according to claim 17 wherein said placement pins are connected to at least a portion of a replacement front rail section.

* * * * *